US012723289B2

(12) United States Patent
Wu

(10) Patent No.: US 12,723,289 B2
(45) Date of Patent: Sep. 1, 2026

(54) Nb MICROALLOYED HIGH STRENGTH HIGH HOLE EXPANSION STEEL AND PRODUCTION METHOD THEREFOR

(71) Applicant: BAOSHAN IRON & STEEL CO., LTD., Shanghai (CN)

(72) Inventor: Jianchun Wu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 1119 days.

(21) Appl. No.: 17/761,719

(22) PCT Filed: Sep. 17, 2020

(86) PCT No.: PCT/CN2020/115964
§ 371 (c)(1),
(2) Date: Mar. 18, 2022

(87) PCT Pub. No.: WO2021/052434
PCT Pub. Date: Mar. 25, 2021

(65) Prior Publication Data

US 2022/0389534 A1 Dec. 8, 2022

(30) Foreign Application Priority Data

Sep. 19, 2019 (CN) ..... 201910888756.7
Sep. 19, 2019 (CN) ..... 201910889397.7

(51) Int. Cl.
*C21D 9/52* (2006.01)
*B22D 11/06* (2006.01)
(Continued)

(52) U.S. Cl.
CPC ..... *C21D 9/52* (2013.01); *B22D 11/0622* (2013.01); *C21D 1/613* (2013.01); *C21D 6/005* (2013.01);
(Continued)

(58) Field of Classification Search
None
See application file for complete search history.

(56) References Cited

U.S. PATENT DOCUMENTS

2011/0024004 A1* 2/2011 Azuma ..... C23C 2/024 148/333

FOREIGN PATENT DOCUMENTS

CN 101928881 A 12/2010
CN 101999007 A 3/2011
(Continued)

OTHER PUBLICATIONS

International Search Report for PCT/CN2020/115964 dated Dec. 9, 2020.
(Continued)

*Primary Examiner* — Anthony M Liang
(74) *Attorney, Agent, or Firm* — Lei Fang, Esq.; Smith Tempel Blaha LLC

(57) ABSTRACT

Disclosed are a Nb microalloyed high strength high hole expansion steel comprising in percentages by weight: 0.01-0.05% of C, 0.2-0.6% of Si, 0.8-1.5% of Mn, ≤0.02% of P, ≤0.005% of S, ≤0.008% of N, <0.001% of Als, ≤0.0050% of Ca, 0.01-0.08% of Nb, and optionally one or both of 0.1-0.6% of Cu and 0.005-0.04% of Sn, wherein Mn/S>250, total oxygen $[O]_T$ is 0.007-0.020%, and the balance is Fe and inevitable impurities, and a method for manufacturing the same. The present disclosure makes full use of steel scraps as raw materials to reduce cost of molten steel and further reduce production process costs and improve product performance through the short process advantages of thin strip continuous casting.

14 Claims, 4 Drawing Sheets

(51) Int. Cl.

| | |
|---|---|
| ***C21D 1/613*** | (2006.01) |
| ***C21D 6/00*** | (2006.01) |
| ***C21D 8/02*** | (2026.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |

(52) U.S. Cl.

CPC ..... *C21D 6/008* (2013.01); *C21D 8/02* (2013.01); *C21D 8/0226* (2013.01); *C21D 8/0236* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/16* (2013.01); *C21D 2211/002* (2013.01); *C21D 2211/005* (2013.01)

(56) References Cited

FOREIGN PATENT DOCUMENTS

| | | | |
|---|---|---|---|
| CN | 102791896 | A | 11/2012 |
| CN | 103492599 | A | 2/2014 |
| CN | 104114731 | A | 10/2014 |
| CN | 104357743 | A | 2/2015 |
| CN | 108570604 | A | 9/2018 |
| CN | 109563601 | A | 4/2019 |
| JP | 20077321169 | A | 12/2007 |

OTHER PUBLICATIONS

International Written Opinion for PCT/CN2020/115964 dated Dec. 9, 2020.

* cited by examiner

Nb MICROALLOYED HIGH STRENGTH HIGH HOLE EXPANSION STEEL AND PRODUCTION METHOD THEREFOR

CROSS-REFERENCE TO RELATED APPLICATIONS

This application is a 371 U.S. National Phase of PCT International Application No. PCT/CN2020/115964 filed on Sep. 17, 2020, which claims benefit and priority to Chinese patent application No. CN 201910888756.7.0 filed on Sep. 19, 2019 and Chinese patent application No. CN 201910889397.7 filed on Sep. 19, 2019, the contents of each of the above listed applications are incorporated by reference herein in their entireties.

TECHNICAL FIELD

The present disclosure relates to a technology for producing high hole expansion steel, in particular to a Nb microalloyed high strength high hole expansion steel and a manufacturing method therefor.

BACKGROUND ART

In the traditional steel production process, tin (Sn) and copper (Cu) are typical residual elements or harmful elements in steel. It is very difficult and expensive to fully remove Sn and Cu during the steelmaking process. Once the steel contains the elements Sn, Cu, they usually cannot be completely eliminated. The content of Sn, Cu can be only reduced by diluting the molten steel, resulting in the increase of the smelting cost of iron and steel products.

In recent years, due to the continuous recycling of steel scrap, there are more and more steel scrap resources, and the price of electricity has continued to decrease. Domestic scrap-based short-process electric furnace steelmaking is increasingly emerging, resulting in a gradual increase in the content of residual elements such as Sn and Cu in steel. Sn and Cu in steel are easy-to-segregate elements, which are easy to accumulate at grain boundaries and cause defects such as cracks. Therefore, the content of Sn and Cu elements is strictly controlled in the traditional process. In ordinary structural steel, there are clear requirements for the content of Sn and Cu: Sn (wt %)≤0.005%; Cu (wt %)≤0.2%.

Therefore, if the residual elements such as Sn and Cu in steel (especially steel scrap) can be reasonably utilized and "turned from harm into profit", it will have a positive impact on the entire metallurgical industry, and the effective utilization of existing steel scrap or low-quality and inferior mineral resources (high-tin ores, high-copper ores) can be realized, thereby promoting the recycling of steel, reducing production costs, and achieving sustainable development of the steel industry.

Traditional thin strip steel is mostly produced by multi-pass continuous rolling of a cast slab having a thickness of 70-200 mm. The traditional hot rolling process is: continuous casting+cast slab reheating and heat preservation+rough rolling+finish rolling+cooling+coiling. Particularly, a cast slab having a thickness of about 200 mm is firstly obtained by continuous casting; the cast slab is reheated and held; then, rough rolling and finish rolling are performed to obtain a steel strip having a thickness generally greater than 2 mm; and finally, laminar cooling and coiling are performed on the steel strip to complete the entire hot rolling production process. If a steel strip having a thickness of less than or equal to 1.5 mm is to be produced, it is relatively difficult, because subsequent cold rolling and annealing of the hot-rolled steel strip are generally necessary. In addition, the long process flow, the high energy consumption, the large number of unit devices, and the high capital construction cost result in high production cost.

The thin slab continuous casting and rolling process flow is: continuous casting+heat preservation and soaking of the cast slab+hot continuous rolling+cooling+coiling. The main differences between this process and the traditional process are as follows: the thickness of the cast slab in the thin slab process is greatly reduced to 50-90 mm Because the cast slab is thin, the cast slab only needs to undergo 1-2 passes of rough rolling (when the thickness of the cast slab is 70-90 mm), or does not need to undergo rough rolling (when the thickness of the slab is 50 mm). In contrast, the continuous casting slab in the traditional process needs to be rolled repeatedly for multiple passes before it can be thinned to the required gauge before finish rolling. In addition, the cast slab in the thin slab process does not undergo cooling, but enters a soaking furnace directly for soaking and heat preservation, or a small amount of heat is supplemented. Hence, the thin slab process greatly shortens the process flow, reduces energy consumption, reduces investment, and thus reduces production cost. However, due to the fast cooling rate, the thin slab continuous casting and rolling process increases the steel strength and yield ratio, thereby increasing the rolling load, so that the thickness gauge of the hot-rolled products that can be economically produced cannot be too thin, generally ≥1.5 mm See Chinese patents CN200610123458.1, CN200610035800.2 and CN200710031548.2, none of which mentions the elements Sn or Cu.

The endless thin slab continuous casting and rolling process (ESP in short) rising in recent years is an improved process developed on the basis of the above semi-endless thin slab continuous casting and rolling process. The ESP realizes endless rolling for continuous casting of a slab, and eliminates the flame cutting of the slab and the heating furnace that is used for heat preservation, soaking and transition of slabs. The length of the entire production line is greatly shortened to about 190 meters. The slab produced by continuous casting with a continuous casting machine has a thickness of 90-110 mm and a width of 1100-1600 mm. The slab produced by continuous casting passes through an induction heating roll table to effect heat preservation and soaking on the slab. Then, the slab enters the rough rolling, finish rolling, laminar cooling, and coiling processes to obtain a hot-rolled plate. Since this process realizes endless rolling, a hot-rolled plate having a minimum thickness of 0.8 mm can be obtained, which expands the range of the gauge of hot-rolled plates. In addition, the output of a single production line can reach 2.2 million t/year. At present, this process has been developed and promoted rapidly, and there is a plurality of ESP production lines in operation around the world.

The thin strip continuous casting and rolling process has a shorter process flow than the thin slab continuous casting and rolling process. The thin strip continuous casting technology is a cutting-edge technology in the research field of metallurgy and materials. Its appearance brings about a revolution to the steel industry. It changes the production process of steel strip in the traditional metallurgical industry by integrating continuous casting, rolling, and even heat treatment, so that the thin strip blank produced can be formed into a thin steel strip at one time after one pass of online hot rolling. Thus, the production process is simplified greatly, the production cycle is shortened, and the length of the process line is only about 50 m. The equipment investment is also reduced accordingly, and the product cost is significantly reduced. It is a low-carbon, environmentally friendly process for producing a hot-rolled thin strip. The twin-roll thin strip continuous casting process is the main form of the thin strip continuous casting process, and it is also the only thin strip continuous casting process that has been industrialized in the world.

A typical process flow of twin-roll thin strip continuous casting is shown by FIG. 1. The molten steel in the ladle 1 passes through a ladle shroud 2, a tundish 3, a submerged nozzle 4 and a distributor 5, and is then directly poured into a molten pool 7 formed with side sealing plate devices 6*a*, 6*b* and two counter-rotating crystallization rolls 8*a*, 8*b* capable of rapid cooling. The molten steel solidifies on the circumferential surfaces of the rotating crystallization rolls 8*a*, 8*b* to form a solidified shell which gradually grows, and then forms a 1-5 mm thick steel strip 11 at the minimum gap (nip point) between the two crystallization rolls. The steel strip 11 is guided by a guide plate 9 to pinch rolls 12 and sent to a rolling mill 13 to be rolled into a thin strip of 0.7-2.5 mm, and then cooled by a cooling device 14. After its head is cut off by a flying shear 16, it is finally sent to a coiler 19 to be coiled into a coil.

High hole-expanding steel is an important steel grade of advanced high-strength steel (AHSS), which has high strength, elongation, excellent formability and flanging performance, and can meet the requirements of complex-shaped auto parts with high forming performance requirements, such as vehicle chassis rear axle suspension swing arms. It can also be used on other parts that require flanged flanging. Its flanging ability is expressed by the hole expansion rate. The hole expansion performance is a formability index of the steel, which reflects the resistance of the material in the direction perpendicular to the hole edge against local cracks due to the excessive local elongation and deformation of the hole edge during the hole expansion process.

With the increasing demand of the chassis structure in automobile design, the forming of parts is more complex, and the requirement of flanging and hole expansion performance of the steel plate is further increased. The strength and rigidity of the auto part can be improved through flanging and the local expanded hole shape design, thereby achieving the purpose of thin and lightweight of automobile steel plate. Structural steel plates made of traditional carbon-manganese solid solubilized strengthened steel and low alloy precipitation strengthened steel are difficult to meet the forming requirement of automotive chassis and cantilever parts. For example, traditional 440 MPa steel plate made of carbon-manganese solid solubilized strengthened steel and low alloy precipitation strengthened steel has a hole expansion rate of only 50 to 70%. Thus, high hole expansion steel is born. In the 1990s, the United States, Japan, etc. have successively developed a 440-780 MPa grade high hole expansion hot-rolled steel plate having a hole expansion rate of 70% to 131%, which is mainly used in parts such as automotive chassis, wheels, etc. having high requirements of formability, especially the flanging performance. The expansion properties of the steel plate are related to the components, strength and structural uniformity of the steel plate. Since it contains more valuable alloy elements Cr, Nb, Ti, V and Mo, etc., although ferrite/bainite dual-phase structure can be obtained under a low cooling rate, its cost is higher.

In the past, in order to meet the conditions for using a steel plate on chassis, there are generally two options: one is to use a steel plate having reduced strength (≤300 MPa) to achieve higher hole expansion performance; the other is to reduce the flanging amount in part design to reduce the requirement of hole expansion performance of the steel plate. With the continuous improvement of automotive steel strength, the hole expansion rate of traditional automotive steel has decreased, and it has been difficult to meet the requirements of auto chassis on the hole expansion rate of the steel plate. Further, with the increasing demand of the chassis structure in automotive design, the shape of the parts is getting more complex, the strength requirements are constantly increasing, and the hole-expansion rate of steel plates also increases. High hole-expansion steel has become an important variety of automotive steel.

At present, the strength level of the most commonly used high hole-expansion steel is mainly focused on 440 MPa and 590 MPa grade, and its microstructure is mainly ferrite and bainite, sometimes containing a small amount of martensite. The hole-expansion performance of the steel plate is related to a variety of factors, including: inclusion level, performance differences among the phases in the structure, structural uniformity, yield ratio, and structure types. With respect to the structure type, the structure of ferrite and bainite has a relatively high hole-expansion performance, but its strength is relatively low and it is difficult to attain 780 MPa grade and above. This is also the main reason why the majority of high hole-expansion steel is in two strength levels of 440 MPa and 590 MPa grade. High hole-expansion steel has become one important variety of automobile steel plates.

Due to the natural advantage of the thin strip continuous casting process, it is easy to generate the microstructure of bainite during the post-rolling cooling of the thin strip continuous casting process compared with the traditional hot rolling process, and it is easy to make the product produced with excellent hole-expansion performance. Therefore, the thin strip continuous casting process has a natural advantage in the production of high hole-expansion steel.

When thin strip continuous casting is employed to produce high hole expansion steel, it is mainly aimed at the hot-rolled thin-gauge automotive steel market with a thickness of less than 1.8 mm (inclusive). Due to the thin thickness, the thin strip continuous casting process has strong manufacturing and cost advantages. The characteristic thickness gauges of the high hole expansion steel strip supplied directly in hot rolled/pickled condition include 1.2 mm, 1.25 mm, 1.4 mm, 1.5 mm, 1.6 mm, 1.7 mm, and 1.8 mm, etc. Due to the thin thicknesses of the products, traditional thin-gauge, high hole expansion steels are often unable to be supplied in full-scale due to the limit of a traditional production line of hot continuous rolling in many plants. They are generally produced by a hot continuous rolling process followed by a cold rolling process. Such a production flow increases the cost for producing thin-gauge, high hole expansion steel.

When hot-rolled strip steel is used as a thin-gauge hot-rolled product, surface quality requirements of the strip are not the highest. It is generally required that the thickness of the oxide scale on the surface of strip steel should be as thin as possible. This requires control of the formation of the oxide scale on the cast strip in the subsequent stages. A closed chamber is used from the crystallization rolls to the inlet of the rolling mill to prevent oxidation of the cast strip. Addition of hydrogen to the closed chamber as disclosed in U.S. Pat. No. 6,920,912 and control of the oxygen content to be less than 5% in the closed chamber device as disclosed in US Patent Application US20060182989 can both help to control the thickness of the oxide scale on the cast strip surface. However, there are few patents relating to how to control the thickness of the oxide scale in the conveying process from the rolling mill to the coiler, especially in the process of cooling the strip steel by laminar cooling or spray cooling. When the high-temperature strip steel is in contact with the cooling water, the thickness of the oxide scale on the surface of the cast strip grows rapidly. At the same time, the contact of the high-temperature strip steel with the cooling water may also cause many problems: first, water spots (rust spots) may be formed on the surface of the strip steel, which will affect the surface quality; second, cooling water for laminar cooling or spray cooling tends to cause local uneven cooling on the surface of the strip steel, resulting in a nonuniform microstructure inside the strip steel, so that the properties of the strip steel are not uniform and the product quality are affected; third, the local uneven cooling on the surface of the strip steel may cause deterioration of the strip shape, which affects the shape quality.

However, because the thin strip continuous casting process itself is characterized by rapid solidification, the steel produced by this process generally has problems such as nonuniform structure, low elongation, high yield ratio and poor formability. At the same time, the austenite grains in the cast strip are obviously not uniform, such that the structure of the final product obtained after austenite transformation is not uniform, either. Hence, the properties of the product are not stable. Therefore, it's also somewhat difficult and challenging to produce high hole expansion products required by the automotive industry and petrochemical industry with the use of a thin strip continuous casting production line. Therefore, when thin strip continuous casting process is used to produce high hole expansion steel, it is impossible to copy the traditional composition and process, and breakthrough in both composition and process is necessary.

Chinese Patent Publication CN103602890 discloses a 540 MPa grade tensile-strength high hole-expansion steel and a manufacturing method therefor. This patent utilizes traditional continuous casting+traditional hot rolling processes for production, and uses one stage of conventional laminar cooling.

Chinese Patent Publication CN103602890 discloses a 440 MPa grade tensile-strength high hole-expansion steel and a manufacturing method therefor. This patent utilizes traditional continuous casting+traditional hot rolling processes for production, and uses one section of conventional laminar cooling.

Chinese Patent Publications CN105154769 and CN106119702 disclose a 780 MPa, 980 MPa grade high strength high hole-expansion hot rolled steel and a manufacturing method therefor respectively, both of which are high strength steel and achieve the reinforcement of steel grades by adding a large amount of microalloying elements such as Ti, Mo, and Ti, Nb, Cr, V and the like with relatively high alloy cost. At the same time, they utilize traditional continuous casting+traditional hot rolling process for production.

International Patent Application WO200928515 uses C, Si, Mn with the addition of a small amount of Nb, Ti alloy elements and can produce a hole expansion steel having a tensile strength of more than 490 MPa. Two-stage laminar cooling mode must be used in hot rolling. The two-stage cooling control can be simulated accurately in the laboratory to get good test results. However, in hot rolling production, the strip speed in hot rolling varies greatly, and the temperature of the steel plate in the air-cooling section cannot be measured. If two-stage cooling model is used to control laminar cooling, the actual temperature of the steel plate fluctuates greatly, which is prone to cause the performance fluctuations in the head, middle and tail of the steel coil.

SUMMARY

One object of the present disclosure is to provide a Nb microalloyed high strength high hole expansion steel and a manufacturing method therefor, which makes full use of the short process advantages of thin strip continuous casting to further reduce production process costs and improve product performance. In some embodiments, the present disclosure makes full use of steel scraps as raw materials to reduce cost of molten steel and further reduce production process costs and improve product performance through the short process advantages of thin strip continuous casting.

To achieve the above object, the technical solution of the present disclosure is as follows:

According to the present disclosure, micro-alloy elements such as Nb and the like are selectively added to the steel (including steel scrap containing Cu and/or Sn). In the smelting process, the basicity of the slag, the type and melting point of the inclusions in the steel, the free oxygen content in the molten steel, and the content of acid-soluble aluminum Als are controlled. Then, twin-roll thin strip continuous casting is performed to cast a cast strip having a thickness of 1.5-3 mm After the cast strip exits the crystallization rolls, it directly enters a lower closed chamber having a non-oxidizing atmosphere, and enters an on-line rolling mill for hot rolling under closed conditions. The strip steel is cooled by gas atomization cooling after rolling. The gas atomization cooling can effectively reduce the thickness of the oxide scale on the surface of the strip steel, increase the temperature uniformity of the strip steel, and improve the surface quality of the strip steel. Finally, the steel coil produced may be used directly as hot rolled plate or after pickling-flattening.

Particularly, the Nb microalloyed high strength high hole expansion steel according to the present disclosure comprises the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050%, Nb: 0.01-0.08%, optionally one or both of Cu 0.1-0.6% and Sn 0.005-0.04%, wherein, Mn/S>250, total oxygen $[O]_T$: 0.007-0.020%, and a balance of Fe and unavoidable impurities.

In some embodiments, the Nb microalloyed high strength high hole expansion steel comprises the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050%, Nb: 0.01-0.08%, Mn/S>250, total oxygen $[O]_T$: 0.007-0.020%, and a balance of Fe and unavoidable impurities, and satisfies: it comprises one or both of Cu 0.1-0.6% and Sn 0.005-0.04%. Preferably, the Nb microalloyed high strength high hole expansion steel is high strength high hole expansion steel based on steel scrap.

In some embodiments, the Nb microalloyed high strength high hole expansion steel comprises the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050%, Nb: 0.01-0.08%, Mn/S>250, total oxygen $[O]_T$: 0.007-0.020%, and a balance of Fe and unavoidable impurities.

The high hole expansion steel according to the present disclosure has a microstructure of ferrite (F)+bainite (B), wherein the bainite (B) phase has a ratio of ≥15%.

The Nb microalloyed high strength high hole expansion steel according to the present disclosure has a yield strength of ≥440 MPa, a tensile strength of ≥590 MPa, a elongation of ≥19%, and a hole expansion rate of ≥100%.

In the chemical composition design of the Nb microalloyed high strength high hole expansion steel according to the present disclosure:

C: C is the most economical and basic strengthening element in the steel. It increases the steel strength by solid solution strengthening and precipitation strengthening. C is an essential element for precipitation of cementite during austenite transformation. Hence, the level of C content largely determines the strength level of the steel. That is, a higher C content leads to a higher strength level. However, since the interstitial solid solution and precipitation of C do great harm to the plasticity and toughness of the steel, and an unduly high C content is unfavorable to the welding performance, the C content cannot be too high. The steel strength is compensated by appropriate addition of an alloy element(s). At the same time, for conventional slab continuous casting, casting in the peritectic reaction zone is prone to produce cracks in the surface of the cast slab, and breakout accidents may occur in severe cases. The same is true for thin strip continuous casting, i.e. casting in the peritectic reaction zone is prone to produce cracks in the surface of the cast strip blank, and the strip will be broken in severe cases. Therefore, the thin strip continuous casting of Fe—C alloy also needs to circumvent the peritectic reaction zone. Hence, the content of C used according to the present disclosure is in the range of 0.01-0.05%.

Si: Si plays a role in solid solution strengthening in the steel, and the addition of Si to the steel can fulfill deoxygenation and improve steel purity. At the same time, Si can expand the range of ferrite formation and avoid the appearance of pearlite phase. However, if the Si content is unduly high, it is easy to form "red scale" defects on the surface of the steel plate after rolling. Hence, the content of Si used according to the present disclosure is in the range of 0.2-0.6%.

Mn: Mn is one of the cheapest alloy elements. It can improve the hardenability of the steel. It has a considerable solid solubility in the steel and increases the steel strength by solid solution strengthening with no damage to the plasticity or toughness of the steel. It is the most important strengthening element to improve the steel strength, and it can also play a role in deoxygenation in the steel. However, an unduly high content of Mn will deteriorate weldability and toughness of the welding heat affected zone. Hence, the content of Mn used according to the present disclosure is in the range of 0.8-1.5%.

P: If the content of P is high, it is prone to segregate at the grain boundary, so that the cold brittleness of the steel will be increased, thereby worsening the weldability, and the plasticity of the steel will be decreased, thereby worsening the cold bendability. In the thin strip continuous casting process, the solidification and cooling rate of the cast strip is extremely fast, and thus the segregation of P can be suppressed effectively. As a result, the disadvantages of P can be avoided effectively, and full use of the advantages of P can be made. Therefore, according to the present disclosure, the P content is higher than that used in the traditional production process, and the limitation to the content of P element is relaxed appropriately. The dephosphorization process is eliminated from the steelmaking process. In the practical operation, it's not necessary to perform the dephosphorization process or add phosphorus intentionally, and the content of P is in the range ≤0.02%.

S: Generally, S is a harmful element in the steel. Particularly, it introduces hot shortness to the steel, reduces the ductility and toughness of the steel, and causes cracks during rolling. S is easy to form MnS in steel, and the amount and morphology of sulfide in steel directly affect the hole expansion rate of the steel plate, and S must be less than 0.005%. The amount and morphology of inclusion elements have a great influence on the hole expansion performance of the steel plate, especially the strip-shaped sulfide inclusions easily lead to cracks during deformation. Therefore, according to the present disclosure, S is also controlled as an impurity element, and its content is in the range of ≤0.005%. In addition, Mn/S>250.

Als: In order to curb the inclusions in the steel, Al cannot be used for deoxygenation as required by the present disclosure. In the use of refractories, additional introduction of Al should also be avoided as far as possible, and the content of acid-soluble aluminum Als should be strictly controlled: <0.001%.

N: Similar to C element, N element can improve the steel strength by interstitial solid solution. However, the interstitial solid solution of N harms the plasticity and toughness of the steel to a relatively large extent, and the existence of free N may increase the yield ratio of the steel. Hence, the N content should not be too high. The content of N used according to the present disclosure is in the range of ≤0.008%. In some embodiments, the content of N is in the range of 0.004-0.008%.

Nb: In the thin strip continuous casting process, due to its unique characteristics of rapid solidification and rapid cooling, the alloy element Nb that is added may exist mainly in a solid solution state in the steel strip. Even if the steel strip is cooled to room temperature, precipitation of Nb can hardly be observed. Nb element which is solid dissolved in the steel can play a role in solid solution strengthening. The Nb content designed according to the present disclosure is in the range of 0.01-0.08%.

Ca: Ca can change the morphology of sulfide in the steel, so that the strip-shaped MnS inclusions are converted to the spherical CaS inclusions, thereby improving the plasticity and toughness of the steel plate and promoting the increase of hole expansion rate of the steel plate. In the present disclosure, the Ca content is controlled to be ≤0.0050%. In some embodiments, the content of Ca is in the range of 0.001-0.005%.

Cu: Cu in the steel mainly plays a role in solid solution strengthening and precipitation strengthening. Since Cu is an element prone to segregation, the content of Cu is generally strictly controlled in the traditional process. In view of the rapid solidification effect of thin strip continuous casting, the upper limit of Cu is increased to 0.60% according to the present disclosure. FIG. 2 shows the effect of copper on the interfacial heat flow. Copper elements with different compositions are added to the steel. From the experimental results, it can be seen that with the increase of copper content, the peak heat flow of the interfacial heat transfer of the steel decreases, and the average heat flow also decreases. When the Cu content reaches 0.80%, there are still higher peak heat flow and average heat flow. When the Cu content is greater than 2.5%, the peak heat flow and average heat flow are significantly reduced. In the present disclosure, the content of Cu is controlled between 0.1-0.6%, and it has little influence on the peak heat flow and average heat flow caused by Cu element. In a certain sense, the increased Cu content can realize effective utilization of copper in steel scrap or inferior mineral resources (high-copper ores), promote the recycling of steel, reduce production cost, and achieve the purpose of sustainable development. It is worth noting that, in the present disclosure, the Cu element in the steel scrap is fully utilized, and there is no need to add additional metal Cu that will increase the cost of steelmaking.

Sn: Sn element is also one of the main participating elements in steel scrap. It is recognized as a harmful element in steel. Because Sn is an element prone to segregation, Sn even in a small amount may be enriched at the grain boundary, resulting in defects such as cracks. Therefore, the content of Sn element is strictly controlled in the traditional process. Because thin strip continuous casting has the characteristic of rapid solidification, interdendritic segregation of an element is greatly reduced. As a result, the solid solubility of the element can be increased greatly. Therefore, under the conditions of the thin strip continuous casting process, the content range of Sn element can be expanded, and the steelmaking cost can thus be reduced greatly. FIG. 3 shows the relationship between Sn element and average heat flux. It can be seen from FIG. 3 that when the amount of Sn added is less than 0.04%, there is little influence on the heat flux. That is, there is no influence on the solidification process of the thin strip. FIG. 4 shows the relationship between Sn content and surface roughness. Because cracks on the surface of a cast strip are usually generated at the uneven folds on the surface of the cast strip, surface roughness is used to characterize the occurrence of the surface cracks. If the roughness is large, the probability of cracking is high. It can be seen from FIG. 4 that the increase of the Sn content has no adverse influence on the surface quality of the cast strip under the condition of rapid solidification. As it can be seen from the results in FIGS. 3 and 4, Sn has no adverse influence on the solidification and surface quality of the cast strip. Therefore, according to the present disclosure, the limitation to the Sn content may be further relaxed, and the designed Sn content is in the range of 0.005-0.04%. It is worth noting that, in the present disclosure, the Sn element in the steel scrap is fully utilized, and there is no need to add additional metal Sn that will increase the cost of steelmaking.

A manufacturing method for the Nb microalloyed high strength high hole expansion steel according to the present disclosure comprises the following steps:

1) Smelting wherein smelting is performed on the above chemical composition; wherein during smelting, a basicity a=$CaO/SiO_2$ (mass ratio) for slagging is controlled at a<1.5, preferably a<1.2, or a=0.7-1.0; wherein a low-melting-point $MnO—SiO_2—Al_2O_3$ ternary inclusion is required and a $MnO/SiO_2$ ratio of $MnO—SiO_2—Al_2O_3$ ternary inclusion is controlled at 0.5-2, preferably 1-1.8; wherein a free oxygen content $[O]_{Free}$ in the molten steel is 0.0005-0.005%; and wherein in the molten steel, Mn/S>250;

2) Continuous Casting wherein twin-roll thin strip continuous casting is used for continuous casting, wherein a 1.5-3 mm thick cast strip is formed at the smallest gap between two crystallization rolls; wherein the crystallization rolls have a diameter of 500-1500 mm, preferably 800 mm; wherein water is supplied to the inside of the crystallization rolls for cooling; wherein a casting machine has a casting speed of 60-150 m/min; wherein a two-stage system for dispensing and distributing molten steel is used for molten steel delivery in the continuous casting, i.e., a tundish+a distributor;

3) Lower Closed Chamber Protection wherein after a cast strip exits the crystallization rolls, the cast strip has a temperature of 1420-1480° C., and it enters a lower closed chamber directly, wherein a non-oxidizing gas is supplied to the lower closed chamber, wherein an oxygen concentration (volume) in the lower closed chamber is controlled at <5%; and wherein the cast strip has a temperature of 1150-1300° C. at an outlet of the lower closed chamber;

4) On-Line Hot Rolling wherein the cast strip is delivered through pinch rolls in the lower closed chamber to a rolling mill, and rolled into a rolled strip steel at a rolling temperature of 1100-1250° C. and a hot rolling reduction rate controlled at 10-50%, preferably 30-50%, wherein the rolled steel strip has a thickness of 0.8-2.5 mm, preferably 1.0-1.8 mm;

5) Post-Rolling Cooling wherein the rolled strip steel is cooled after on-line hot rolling, wherein the strip steel is cooled by gas atomization cooling, wherein a cooling rate of the gas atomization cooling is ≥50° C./s; and 6) Coiling of the Strip Steel wherein the hot-rolled strip steel is directly coiled into a coil after the cooling, wherein a coiling temperature is 470-570° C.

Preferably, in step 1), electric furnace steelmaking or converter steelmaking is employed for the smelting to obtain molten steel. Then, the molten steel enters an LF furnace, a VD/VOD furnace, or an RH furnace.

Preferably, in step 1) in some embodiments, 100% steel scrap is selected as the raw material for smelting without pre-screening, wherein an electric furnace is used for smelting to produce molten steel. Alternatively, a converter is used for smelting to produce molten steel, wherein steel scrap is added to the converter in an amount of ≥20% of the raw material for smelting without pre-screening. Then, the molten steel is delivered to an LF furnace, VD/VOD furnace or RH furnace for refining.

Preferably, in step 3), the non-oxidizing gas is $N_2$, Ar, or $CO_2$ gas produced by sublimation of dry ice.

Preferably, in step 5), the gas atomization cooling utilizes a gas-water ratio of 15:1-10:1, a gas pressure of 0.5-0.8 MPa, and a water pressure of 1.0-1.5 MPa. As used herein, the gas-water ratio refers to the flow ratio of compressed air to water, and the unit of the flow is $m^3/h$.

Preferably, in step 5), the cooling rate is 50-75° C./s.

Preferably, in step 6), the coiling utilizes double-coiler coiling or Carrousel coiling.

Preferably, in step 6), the hot-rolled and cooled strip steel is directly coiled into a coil after a poor-quality head portion of the strip steel is cut off with a head shear, wherein the coiling temperature is 470-570° C.

In the manufacturing method for the Nb microalloyed high strength high hole expansion steel according to the present disclosure:

In order to improve the castability of the molten steel for thin strip continuous casting, the basicity a=$CaO/SiO_2$ for slagging in the steelmaking process is controlled at a<1.5, preferably a<1.2, or a=0.7-1.0.

In order to improve the castability of the molten steel for thin strip continuous casting, it is necessary to obtain a low-melting-point $MnO—SiO_2—Al_2O_3$ ternary inclusion, as shown in the shaded area in FIG. 2. The $MnO/SiO_2$ in the $MnO—SiO_2—Al_2O_3$ ternary inclusion is controlled at 0.5-2, preferably 1-1.8.

In order to improve the castability of the molten steel for thin strip continuous casting, oxygen (O) is an essential element to form an oxide inclusion in the steel. Since it's necessary to form the low-melting-point $MnO—SiO_2—Al_2O_3$ ternary inclusion according to the present disclosure, the free oxygen $[O]_{Free}$ in the molten steel is required to be in the range of 0.0005-0.005%.

In order to improve the castability of the molten steel for thin strip continuous casting, among the above components, Mn and S must be controlled to satisfy: Mn/S≥250.

Smelting is performed according to the designed chemical composition. Electric furnace steelmaking or converter steelmaking may be employed for the smelting to obtain molten steel. Then, the molten steel enters a refining process, such as an LF furnace, a VD/VOD furnace, an RH furnace, etc.

The rolled strip steel is cooled after on-line hot rolling. Particularly, the strip steel is cooled by gas atomization cooling. The gas atomization cooling process can effectively reduce the thickness of the oxide scale on the strip steel surface, improve the temperature uniformity of the strip steel, and promote the surface quality of the strip steel. The gas atomization cooling utilizes a gas-water ratio of 15:1-10:1, a gas pressure of 0.5-0.8 MPa, and a water pressure of 1.0-1.5 MPa. After gas atomization, a high-pressure water mist is formed and sprayed on the surface of the steel strip. On the one hand, it plays a role in reducing the temperature of the steel strip. On the other hand, the water mist forms a dense gas film which covers the surface of the strip steel to protect the strip steel from oxidation, thereby effectively suppressing the growth of the oxide scale on the surface of the hot-rolled strip steel. With the use of this cooling process, the problems caused by traditional spraying or laminar cooling can be avoided, and the surface temperature of the strip steel can drop uniformly, so as to increase the temperature uniformity of the strip steel, and achieve the effect of homogenizing the internal microstructure. At the same time, the cooling is uniform, and the shape quality and performance stability of the strip steel can be improved. In addition, the thickness of the oxide scale on the surface of the strip steel can be reduced effectively. The cooling rate for the gas atomization cooling is ≥50° C./s. The strip steel is cooled to 470-570° C. to transform the high-temperature austenite after rolling into a mixed microstructure of ferrite+a small amount of bainite, as shown in FIG. 6.

The cooled hot-rolled strip is directly coiled into coils after cutting off the head with poor quality by head shears. The coiling temperature is 470-570° C. The coiler adopts the double coiling form, or the Carrousel coiling form, to ensure the continuous production of strip steel. Preferably, the Carrousel coiling is adopted.

The choice of 100% full steel scrap as raw materials without pre-screening is explained as follows:

Modern steel manufacturers are technically innovating for existing production process to save investment and production costs. In response to the problems of the long process flow and the large number of complicated devices in existing hot strip steel production process, many manufacturers combine the continuous rolling technology with traditional processes to meet the demand for continuous casting and rolling process.

The use of a converter to provide molten steel for steelmaking requires that the manufacturer should have conditions for providing molten iron. Generally, blast furnace ironmaking or non-blast furnace ironmaking equipment is needed. This belongs to the current long-process steel production mode. Nevertheless, since steel scrap resources are increasingly abundant nowadays, the government is advocating increasing the proportion of steel scrap supplied to converters, so as to achieve the purposes of saving energy, reducing consumption and reducing cost. The average level of steel scrap supplied to converters is about 8% in the past. Now and later, the targeted proportion of steel scrap supplied to converters is 15-25%.

When an electric furnace is used to provide molten steel for steelmaking, steel scrap is used as the main raw material. In traditional processes such as die casting or thick slab continuous casting, the solidification cooling rate is only $10^{-1}$-10° C./s. Grain boundary segregation of the residual elements in the steel scrap occurs during the solidification process, which deteriorates the properties and quality of the steel, and even causes direct cracking and fracturing in severe cases. Therefore, in the traditional process, these harmful elements must be strictly controlled. In the selection of steel scrap raw materials, pre-screening is required, and some special treatments are required in the steelmaking process, such as addition of a concentrate for dilution, etc., which undoubtedly increase the production cost. Due to the need to control the steel composition, there are certain quality requirements for the steel scrap raw materials to be used. Generally, the steel scrap needs to be pre-screened and classified. In order to enhance the production efficiency, some domestic electric furnace steel plants choose to add concentrates such as purchased sponge iron, iron carbide and the like to the raw material composition to dilute the harmful elements that are difficult to be removed from the steel scrap, and thus improve the quality of the molten steel. Some domestic steel plants that have both a blast furnace and an electric furnace add self-produced molten iron into the electric furnace as a raw material in the electric furnace to improve the production efficiency of the electric furnace, thereby shortening the tapping time of the electric furnace greatly. The blending ratio of the molten iron in the electric furnace can reach 30-50%.

The twin-roll thin strip continuous casting technology employed according to the present disclosure is a typical sub-rapid solidification process, wherein the solidification cooling rate is as high as $10^{2}$-$10^{4}$° C./s. Some harmful residual elements in steel scrap, such as Cu, Sn, P, etc., can be solid dissolved into the steel matrix to the maximum extent without causing grain boundary segregation, so that when electric furnace steelmaking is adopted, the use of 100% steel scrap for smelting can be achieved without pre-screening, which reduces the raw material cost significantly. When converter steelmaking is adopted for smelting, steel scrap is added to the converter in a proportion of more than 20% of the raw materials for smelting with no need for pre-screening, which maximizes the proportion of steel scrap added into the converter and greatly reduces production costs. These residual elements can also play a role in solid solution strengthening, helping to produce ultra-thin hot-rolled strip steel having excellent properties. For these harmful residual elements in steel scrap, the comprehensive utilization of inferior steel scrap resources for production has the effects of "turning harm into profit" and "waste utilization".

The cast ability of the thin strip continuous casting according to the present disclosure is explained as follows:

There is no exact definition of cast ability. Traditionally, it is a concept that is frequently used and closely related to the molten steel fluidity, cooling tendency, shrinkage characteristics, and product quality, which is relative to metal species and its process factors. The definition of Cast Ability of Strip Casting, CASC, refers to the feasibility of twin-roll casting for a steel grade. Good cast ability means that there is no such restriction problem during casting that the casting process cannot be carried out or the casting product quality does not satisfy the requirement. Poor cast ability means that regular problems during casting such as poor molten steel fluidity, molten pool cakes, severe strip rupture, surface cracks, surface slag inclusion and the like occur, so that the production cannot be carried out normally and stably or the product quality cannot meet the requirement.

The cast ability of thin strip continuous casting of a steel grade is judged through the research and analysis of the cast ability of thin strip continuous casting. To briefly sum up, it can be considered from the following aspects: (1) whether the uneven solidification shrinkage can be avoided; (2) whether the uniformity of interface heat transfer can be improved, thereby improving the uniformity of solidification; (3) whether the hot brittleness during solidification can be improved or controlled. When the cast ability of thin strip continuous casting of a steel grade is very poor, it means that the stability of the production process is very poor, and the quality stability of the produced products is also very poor, which will eventually lead to the failure of production capacity and very low pass rate of products. Such products are not suitable for the production of thin strip continuous casting process.

The steel grade according to the present disclosure strictly satisfies the cast ability of thin strip continuous casting by controlling the carbon content (avoiding the peritectic zone to solve the uneven solidification shrinkage); controlling basicity, Als, free oxygen, total oxygen, and low melting point $MnO—SiO_2—Al_2O_3$ ternary inclusion (improving interface heat transfer uniformity to solve solidification uniformity); and controlling Mn/S (avoiding hot brittleness), etc.

The thin strip continuous casting hot-rolled steel coil according to the present disclosure is preferably spray-cooled after rolling, for the following reasons:

Traditional continuous casting also uses spray cooling, but the area of action and temperature are different. In traditional continuous casting, the slab is spray-cooled in the exit sector area when the slab exits the mould. At this time, the temperature of the slab is relatively high, and it is in the single-phase zone of the high-temperature austenite as seen in the phase diagram. The main purpose of spray cooling in this zone is to control the position of the end of solidification, accelerate the surface cooling of the slab, refine the surface austenite grain structure, improve the surface strength of the slab, improve the surface quality of the slab, and avoid the occurrence of cracks. In the present disclosure, the ultra-thin strip steel is spray-cooled after the on-line hot rolling of the cast strip, the temperature is low, and it is in the solid phase transformation zone of the high temperature austenite to ferrite as seen in the phase diagram. The spray-cooling of the strip steel in this zone by adjusting the spray cooling intensity can effectively control the microstructure after solid-state phase transformation, thereby achieving the performance requirements of the final product.

According to the present disclosure, a Carrousel in-situ coiler is used for the thin strip continuous casting hot-rolled steel coils, for the following reasons:

At present, the vast majority of production lines for ultra-thin hot-rolled steel coils use underground double coiling or underground triple coiling. The main reason is that these production lines also take into account the production of thick-gauge hot-rolled plates. For example, the coiling of the ESP production line of Avedi Corporation adopts the underground triple coiling, and the coiling of the FTSC production line of Danieli introduced by Tang Steel CORP. adopts the underground double coiling. The Castrip thin strip continuous casting production line of Nucor in the United States adopts the traditional method and also adopts the underground double coiling. The distance between the underground coiler and the coiler is generally 8-10 meters (typical value is 9.4 m). When the ultra-thin hot-rolled strip steel is produced by thin strip continuous casting, the cooling rate of strip steel in air is also very fast. Thus, said distance will be sufficient to affect the differences in coiling temperature. The temperature deviation between the two coilers can reach up to 49° C., which can seriously affect the performance deviation of the coil.

However, the present disclosure preferably adopts the Carrousel coiling, which can realize the in-situ coiling of the hot-rolled steel coil, ensure the uniformity of the coiling temperature, and further greatly improve the stability of the performance of the steel coil product. At present, the Carrousel coiler is widely used in the field of cold rolling. The main advantages of the Carrousel coiling include that it can achieve thinner strip steel coiling, and it occupies a small area which can greatly shorten the length of the production line. The Carrousel coiling is easier to achieve in the field of cold rolling due to the lower temperature of the strip. The present disclosure proposes to adopt the Carrousel coiling in the field of ultra-thin hot-rolled strip steel coiling, and realizes the coiling of ultra-thin hot-rolled strip steel by considering the high temperature resistance of the equipment. This coiling method is more advanced than the coiling method of the Castrip thin strip continuous casting production line of Nucor in the United States.

Differences and improvements between the present disclosure and the prior art are as follows:

There are many patents on the thin strip products produced by thin strip continuous casting and the processes thereof, but there is no direct report on the high hole-expansion steel produced by thin strip continuous casting according to the present disclosure.

The most significant features which distinguish the present disclosure from the existing thin strip continuous casting technology include the roll diameter of the crystallization rolls and the corresponding molten steel distribution mode. The technical feature of the EUROSTRIP technology is the crystallization rolls having a large diameter of D1500 mm Due to the large crystallization rolls together with the large capacity of the molten pool, it's easy to distribute the molten steel, but the cost for manufacturing the crystallization rolls and the cost for operation and maintenance are high. The technical feature of the CASTRIP technology is the crystallization rolls having a small diameter of 0500 mm Due to the small crystallization rolls together with the small capacity of the molten pool, it's very difficult to distribute the molten steel, but the cost for manufacturing the casting machine and the cost for operation and maintenance are low. In order to address the challenge of uniform distribution of molten steel in the small molten pool, CASTRIP adopts a three-stage system for dispensing and distributing molten steel (tundish+transition piece+distributor). The use of a three-stage distribution system for molten steel leads to a direct increase in the cost of refractory materials. More importantly, the three-stage distribution system for molten steel extends the flow path of the molten steel, and the temperature drop of the molten steel is also larger. In order to achieve the required temperature of the molten steel in the molten pool, the tapping temperature needs to be increased greatly. The increased tapping temperature will lead to problems such as increased steelmaking cost, increased energy consumption and shortened life of refractory materials.

The crystallization rolls according to the present disclosure have a diameter of 500-1500 mm, with crystallization rolls having a roll diameter of D800 mm being preferred. A two-stage system for dispensing and distributing molten steel (tundish+distributor) is adopted. The molten steel flowing out of the distributor forms different distribution patterns along the roll surfaces and the two side surfaces, and flows in two paths without interfering with each other. Due to the use of a two-stage distribution system, in contrast to a three-stage distribution system, the cost of refractory materials is reduced greatly; and the flow path of the molten steel is shortened, so that the temperature drop of the molten steel is reduced, and the tapping temperature can be lowered. Compared with the three-stage distribution system, the tapping temperature can be lowered by 30-50° C. The decreased tapping temperature can effectively reduce the cost of steelmaking, save energy and prolong the life of refractory materials. The combined use of crystallization rolls having a preferred roll diameter of D800 mm and a two-stage system for dispensing and distributing molten steel according to the present disclosure not only meets the requirement of stable distribution of molten steel, but also achieves the goals of simple structure, convenient operation and low processing cost.

Chinese patent CN101353757 produces a hole-expansion steel having a tensile strength of 440 MPa by using low-carbon microalloy components, with a small amount of Nb: 0-0.25% and Ti: 0-0.03% added in the components. Due to the coiling temperature of 600° C., the patent adopts traditional continuous casting+traditional hot rolling process for production. There is often a banded structure in the carbon-manganese steel hot-rolled plate, which leads to a decrease in the hole expansion rate of the steel plate. At the same time, a variety of microalloys are added, which increases the cost of steelmaking. The present disclosure is obviously different from the patent in the production process. The present disclosure adopts thin strip continuous casting process for production, which can greatly shorten the production process, avoid the banded structure, and save the amount of microalloys. Only a small amount of added microalloys is needed to achieve the same or even more excellent performance.

Chinese patent CN101928881 discloses a hot rolled high hole-expansion steel plate having a tensile strength of 590 Mpa and a manufacturing method therefor. The patented composition is added with a small amount of Nb: 0-0.10% and Ti: 0-0.04%. The steel plate is produced by traditional continuous casting+traditional hot rolling process. After finish rolling, the steel plate is cooled to 600-750° C. at a cooling rate of 50° C./s to 100° C./s, and then cooled in air at a cooling rate of 5° C./s to 15° C./s for 3-10 seconds. Thereafter, the steel plate is cooled again to 350-500° C. at a cooling rate of 70° C./s to 150° C./s and coiled, and then air-cooled to room temperature. Since subsequent cooling adopts complex three-stage cooling, the coiling temperature fluctuates greatly, the performance fluctuation of the steel coil in head, middle and tail is relatively large, and the hole expansion rate also fluctuates greatly. The present disclosure adopts the thin strip continuous casting process for production, which greatly simplifies the production process. There is no need to adopt complex three-stage cooling, and thus the present disclosure has obvious advantages.

Japanese patent JP2006063394 discloses a hot rolled high hole-expansion steel having a carbon content of 0.20-0.48% and a tensile strength ≥440 MPa. Although Cr alloy element is added, the hole-expansion rate is only ≥70%, and annealing treatment at 640° C. is required after hot rolling. The carbon content design of the invention has reached the range of medium and high carbon steel, which is significantly higher than the low carbon design of the present disclosure. The hot-rolled high-strength steel plate disclosed in Japanese patent JP2006305700 adopts the composition design of C—Si-Mn+Ti, to obtain a tensile strength of ≥780 MPa and a hole expansion rate of only ≥68%. The hot rolled high hole-expansion steel disclosed in Japanese patent JP2003/016614 has a carbon content of 0.02-0.10%, Si≤0.5%, and a tensile strength ≥590 MPa. However, due to the addition of many Nb, Ti, V, Cr, RE and other alloy elements, the steelmaking cost is high, and its main goal is good surface paintability. Compared with this patent, the present disclosure adopts a simple alloy composition system and a thin strip continuous casting process to realize the performance of high hole-expansion steel, which has the characteristics of simplicity and high efficiency.

US Patent US2006096678 discloses a hot-rolled steel plate having a strength of ≥780 MPa, an elongation rate of ≥22%, and a hole expansion rate of ≥60%. U.S. Pat. No. 4,415,376 discloses a hot-rolled steel plate strengthened with Nb and V having a yield strength of ≥80 ksi (550 MPa), a hole expansion rate of ≥58%. The production processes used in these patents are traditional continuous casting+traditional hot rolling process, which is different from the production process of the present disclosure. The hole-expansion rate of the products in these patents is low.

The main advantages of the present disclosure include:

The use of thin strip continuous casting technology to produce Nb microalloyed high strength high hole expansion steel, especially the use of thin strip continuous casting technology to produce Nb microalloyed high strength high hole expansion steel containing tin (Sn), copper (Cu)/tin (Sn), copper (Cu) and the method therefor have not been reported so far. The advantages are summarized as follows:

1. According to the present disclosure, complicated processes such as slab heating, multi-pass repeated hot rolling and the like are obviated. With the use of a twin-roll thin strip continuous casting+one-pass on-line hot rolling process, the production process is shorter, the efficiency is higher, and the investment cost for the production line and the production cost are reduced significantly.

2. According to the present disclosure, a good number of complicated intermediate steps in the traditional process for producing high hole expansion steel are obviated. Compared with the traditional high hole expansion steel, the energy consumption and the $CO_2$ emission in the production according to the present disclosure are reduced greatly, and environment-friendly products are obtained.

3. Due to the natural advantages of thin strip continuous casting process, compared with the traditional hot rolling process, it is easy for thin strip continuous casting to generate bainite type microstructure during the cooling process after rolling, and it is easy to produce products with excellent hole expansion performance.

4. The present disclosure adopts the thin strip continuous casting process to produce high hole expansion steel. The thickness of cast strip itself is relatively thin and rolled to the desired product thickness through on-line hot rolling. The production of thin gauge products does not need to undergo cold rolling, and is directly supplied to the market for use to achieve the purpose of supplying thin gauge hot-rolled plates, which can significantly improve the cost-effectiveness of plates and strips.

5. When an electric furnace is used for smelting according to the present disclosure, the raw materials for smelting can truly achieve 100% full scrap smelting without pre-screening and the cost of raw material is greatly reduced. When a converter is used for smelting to produce molten steel, the steel scrap is added to the converter in an amount of ≥20% of the raw material for smelting without pre-screening. The proportion of steel scrap supplied to the converter is increased to a maximum extent and the smelting costs and energy consumption are greatly reduced.

6. The present disclosure utilizes steel scrap containing Cu and Sn. Cu and Sn in the steel are "turned from harm into profit". The full utilization of existing steel scrap or low-quality and inferior mineral resources (high-tin ores, high-copper ores) is realized, thereby promoting the recycling of steel scrap, reducing production costs, and achieving sustainable development of the steel industry.

7. According to the present disclosure, by using gas atomization cooling for the rolled strip steel, the problems caused by traditional spraying or laminar cooling can be avoided, and the surface temperature of the strip steel can drop uniformly, so as to increase the temperature uniformity of the strip steel, and achieve the effect of homogenizing the internal microstructure. At the same time, the cooling is uniform, and the shape quality and performance stability of the strip steel can be improved. In addition, the thickness of the oxide scale on the surface of the strip steel can be reduced effectively.

8. In the traditional process for cooling a slab, precipitation of alloy elements occurs, and re-dissolution of the alloy elements is insufficient when the slab is reheated, so that the utilization rate of the alloy elements is often reduced. In the thin strip continuous casting process according to the present disclosure, the high-temperature cast strip is hot rolled directly, and the added alloy elements mainly exist in a solid solution state. Thus, the utilization rate of the alloy elements can be increased.

9. According to the present disclosure, a Carrousel coiler is used for coiling to effectively shorten the length of the production line. At the same time, the in-situ coiling can greatly improve the control accuracy of the coiling temperature and improve the stability of the product properties.

DETAILED DESCRIPTION

The present disclosure will be further described with reference to the following examples and accompanying drawings, but these examples by no means limit the present disclosure. Any changes made by those skilled in the art in the implementation of the present disclosure under the inspiration of the present specification will fall within the protection scope of the claims in the present disclosure.

Figure 1:
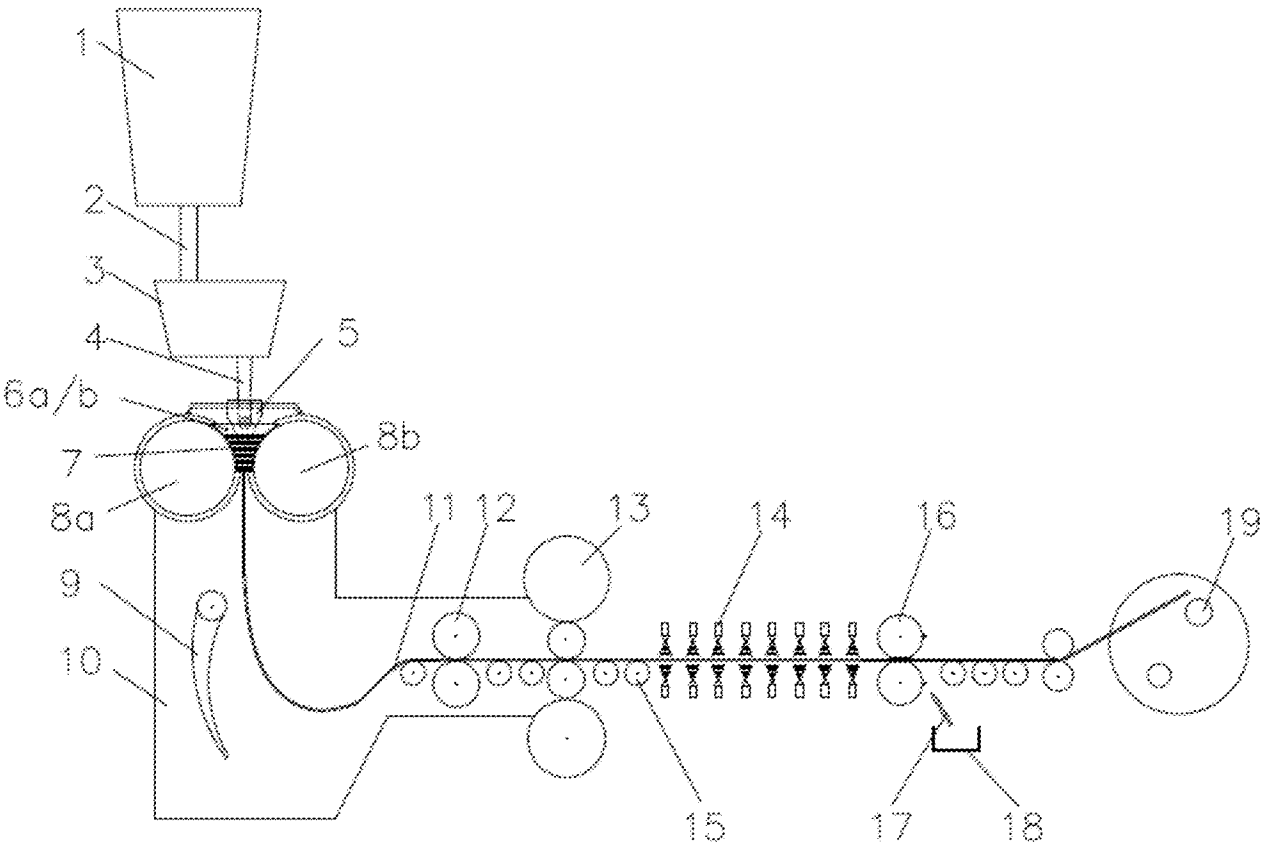
FIG. 1 is a schematic view showing the process layout of a twin-roll thin strip continuous casting process.
Figure 2:
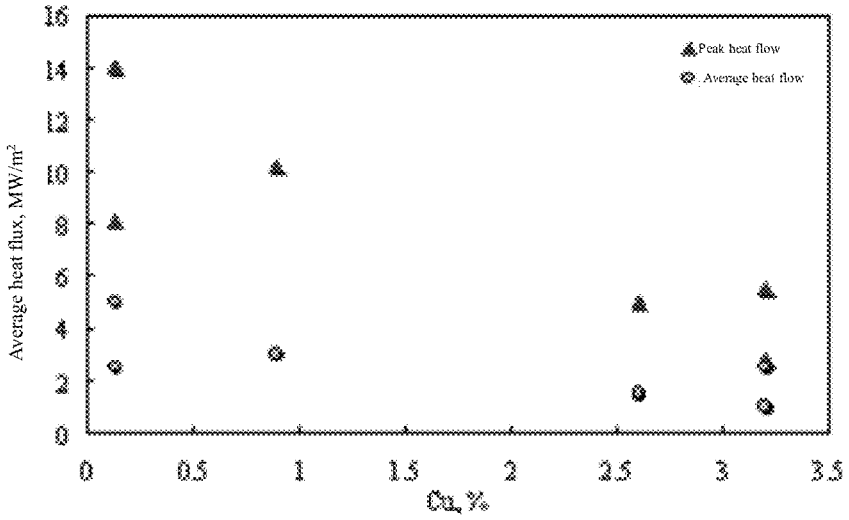
FIG. 2 is a schematic diagram showing the influence of Cu on the interface heat flow.
Figure 3:
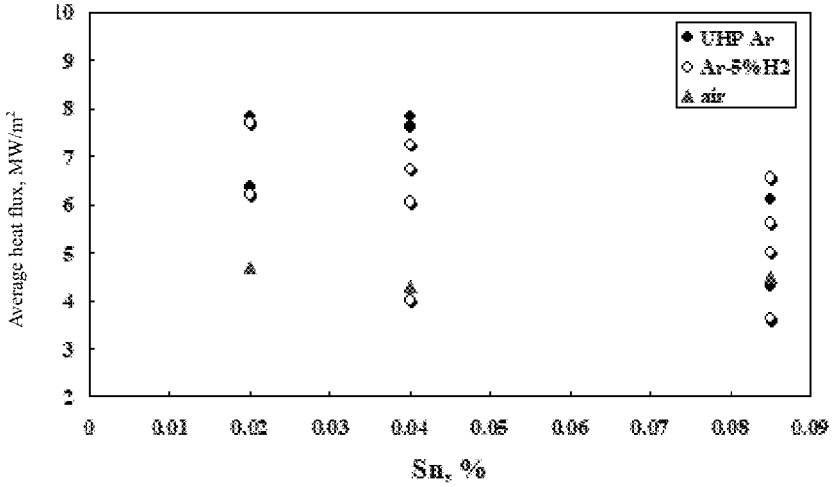
FIG. 3 is a schematic diagram showing the relationship between Sn content and average heat flux.
Figure 4:
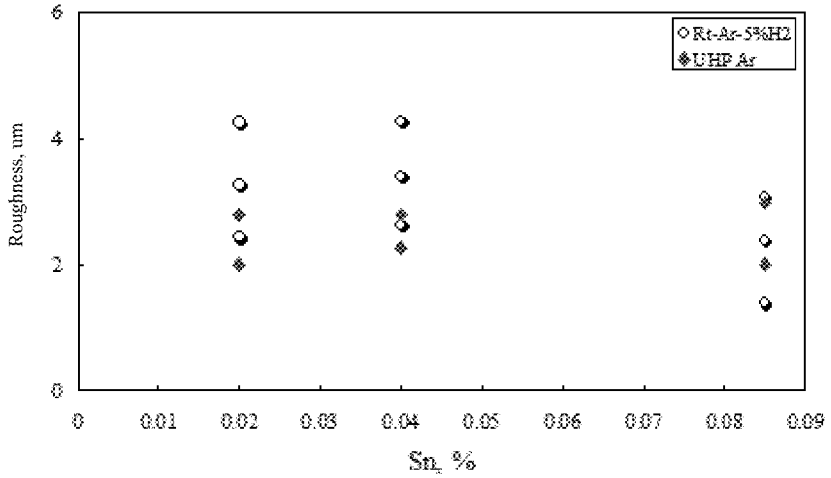
FIG. 4 is a schematic diagram showing the relationship between Sn content and cast strip surface roughness.
Figure 5:
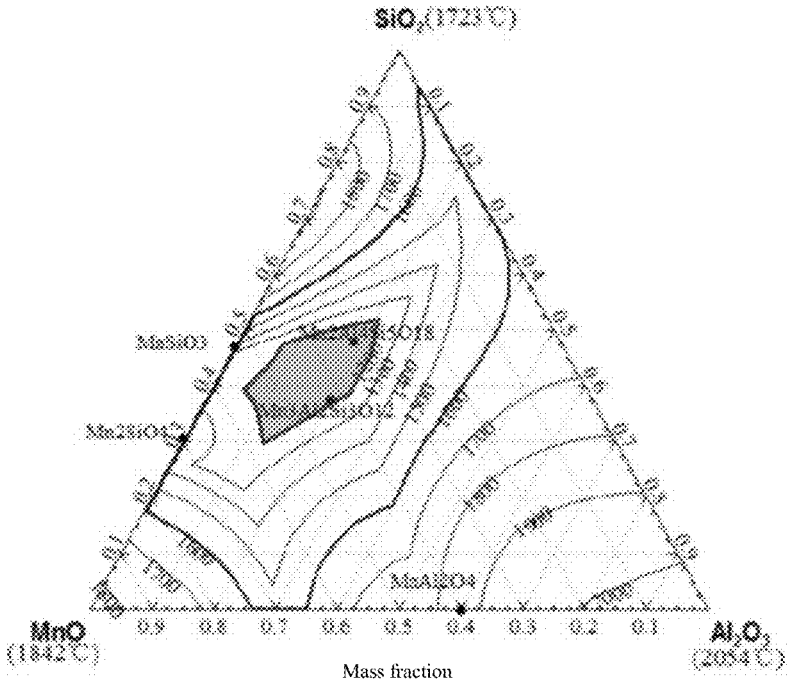
FIG. 5 is a ternary phase diagram of $MnO—SiO_2—Al_2O_3$ (shaded area: low melting point area)
Figure 6:
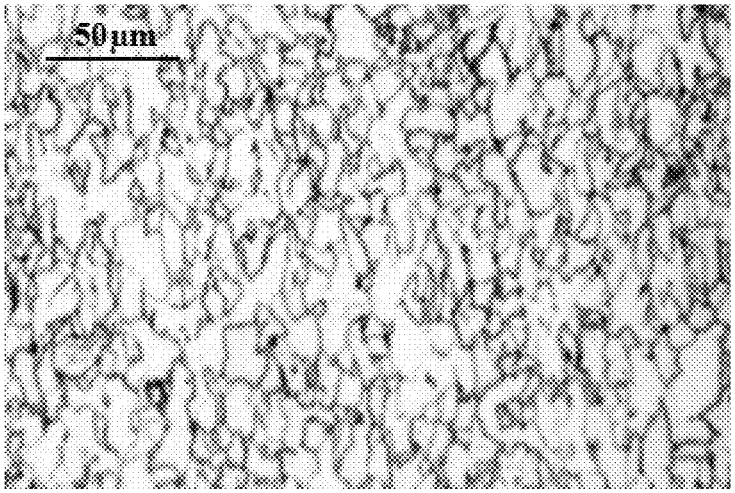
FIG. 6 is the microstructure photograph of the steel in Examples of the present disclosure.

Referring to FIG. 1, the molten steel that conforms to the chemical composition designed according to the present disclosure passes through a ladle 1, a ladle shroud 2, a tundish 3, a submerged nozzle 4 and a distributor 5, and is then directly poured into a molten pool 7 formed with side sealing plate devices 6*a*, 6*b* and two counter-rotating crystallization rolls 8*a*, 8*b* capable of rapid cooling. The molten steel solidifies on the circumferential surfaces of the rotating crystallization rolls 8*a*, 8*b* to form a solidified shell which gradually grows, and then forms a 1.5-3 mm thick cast strip 11 at the minimum gap (nip point) between the two crystallization rolls. The diameter of the crystallization rolls according to the present disclosure is between 500-1500 mm, and water is supplied to the inside of the crystallization rolls for cooling. Depending on the thickness of the cast strip, the casting speed of the casting machine is in the range of 60-150 m/min.

After the cast strip 11 exits the crystallization rolls 8*a* and 8*b*, the temperature of the cast strip is 1420-1480° C., and the cast strip enters a lower closed chamber 10 directly. The lower closed chamber 10 is supplied with a non-oxidizing gas to protect the cast strip, i.e. protecting the cast strip from oxidation. The anti-oxidation protective atmosphere may be $N_2$, or Ar, or other non-oxidizing gas, such as $CO_2$ gas obtained by sublimation of dry ice. The oxygen concentration in the lower closed chamber 10 is controlled to be <5%. The anti-oxidation protection provided by the lower closed chamber 10 to the cast strip 11 extends to the inlet of the rolling mill 13. The temperature of the cast strip at the outlet of the lower closed chamber 10 is 1150-1300° C. Then, the cast strip is delivered to the rolling mill 13 through a swinging guide plate 9, pinch rolls 12 and a roll table 15. After hot rolling, a hot rolled strip steel of 0.8-2.5 mm in thickness is formed. The rolled strip steel is cooled by gas atomization cooling with the use of a gas atomization rapid cooling device 14 to improve the temperature uniformity of the strip steel. After the head portion of the strip steel is cut off by a flying shear 16, the cut head portion falls into a flying shear pit 18 along a flying shear guide plate 17, and the hot-rolled strip steel with the head portion cut off enters a coiler 19 for coiling. After the steel coil is taken off the coiler, it is cooled in air to room temperature. Finally, the steel coil produced may be used as hot rolling plate directly, or used after pickling-flattening.

The chemical compositions of the Examples according to the present disclosure are shown in Table 1, and the balance is Fe and other unavoidable impurities. The process parameters of the manufacturing method according to the present disclosure are shown in Table 2, and the properties of the product obtained finally are shown in Table 3. The hole expansion rate is measured according to the International standard ISO16630:2009.

To sum up, the high hole expansion steel manufactured with the designed steel composition using the thin strip continuous casting process according to the present disclosure has a yield strength of ≥440 MPa, a tensile strength of ≥590 MPa, an elongation of ≥19%, and a hole expansion rate of ≥100%.

TABLE 1

Chemical compositions of the steel Examples (wt. %)

| | C | Si | Mn | P | S | N | O | Als | Nb | Ca |
|---|---|---|---|---|---|---|---|---|---|---|
| Ex. 1 | 0.04 | 0.27 | 1.35 | 0.008 | 0.004 | 0.0064 | 0.0093 | 0.0009 | 0.06 | 0.003 |
| Ex. 2 | 0.05 | 0.20 | 0.90 | 0.013 | 0.003 | 0.0068 | 0.0110 | 0.0006 | 0.05 | 0.004 |

TABLE 1-continued

| Chemical compositions of the steel Examples (wt. %) | | | | | | | | | | |
|---|---|---|---|---|---|---|---|---|---|---|
| | C | Si | Mn | P | S | N | O | Als | Nb | Ca |
| Ex. 3 | 0.02 | 0.38 | 1.28 | 0.015 | 0.004 | 0.0048 | 0.0150 | 0.0004 | 0.03 | 0.005 |
| Ex. 4 | 0.01 | 0.22 | 1.26 | 0.013 | 0.005 | 0.0067 | 0.0130 | 0.0008 | 0.03 | 0.004 |
| Ex. 5 | 0.03 | 0.41 | 0.85 | 0.009 | 0.002 | 0.0062 | 0.0120 | 0.0007 | 0.01 | 0.003 |
| Ex. 6 | 0.04 | 0.45 | 0.80 | 0.012 | 0.002 | 0.0046 | 0.0070 | 0.0008 | 0.04 | 0.001 |
| Ex. 7 | 0.02 | 0.28 | 0.95 | 0.015 | 0.003 | 0.0040 | 0.0100 | 0.0005 | 0.06 | 0.002 |
| Ex. 8 | 0.05 | 0.37 | 1.30 | 0.014 | 0.005 | 0.0080 | 0.0085 | 0.0006 | 0.05 | 0.004 |
| Ex. 9 | 0.04 | 0.36 | 0.84 | 0.018 | 0.003 | 0.0078 | 0.0200 | 0.0003 | 0.04 | 0.004 |
| Ex. 10 | 0.02 | 0.45 | 0.90 | 0.020 | 0.001 | 0.0065 | 0.0125 | 0.0004 | 0.07 | 0.004 |
| Ex. 11 | 0.02 | 0.60 | 0.85 | 0.010 | 0.002 | 0.0080 | 0.0090 | 0.0009 | 0.04 | 0.003 |
| Ex. 12 | 0.03 | 0.59 | 1.50 | 0.012 | 0.005 | 0.0075 | 0.0118 | 0.0003 | 0.06 | 0.001 |
| Ex. 13 | 0.05 | 0.45 | 1.37 | 0.018 | 0.004 | 0.0045 | 0.0132 | 0.0006 | 0.08 | 0.002 |
| Ex. 14 | 0.02 | 0.28 | 1.40 | 0.017 | 0.003 | 0.0064 | 0.0075 | 0.0005 | 0.03 | 0.003 |

TABLE 2

| Process parameters of the Examples | | | | | | | | |
|---|---|---|---|---|---|---|---|---|
| | Cast strip thickness mm | Atmosphere in lower closed chamber | Oxygen concentration in lower closed chamber % | Hot rolling temperature ° C. | Hot rolling reduction rate/% | Hot-rolled strip thickness mm | Post-rolling cooling rate ° C./s | Coiling temperature ° C. |
| Ex. 1 | 2.7 | $N_2$ | 3.3 | 1150 | 35 | 1.75 | 58 | 495 |
| Ex. 2 | 2.6 | Ar | 4.2 | 1200 | 37 | 1.65 | 60 | 535 |
| Ex. 3 | 2.3 | $N_2$ | 2.3 | 1110 | 48 | 1.2 | 59 | 565 |
| Ex. 4 | 1.8 | $CO_2$ | 2.5 | 1150 | 31 | 1.25 | 70 | 560 |
| Ex. 5 | 1.7 | Ar | 3.5 | 1185 | 41 | 1.0 | 52 | 570 |
| Ex. 6 | 3.0 | Ar | 2.8 | 1100 | 40 | 1.8 | 52 | 550 |
| Ex. 7 | 1.9 | $N_2$ | 1.5 | 1190 | 24 | 1.45 | 55 | 505 |
| Ex. 8 | 1.6 | $CO_2$ | 0.6 | 1120 | 22 | 1.25 | 60 | 480 |
| Ex. 9 | 1.5 | $N_2$ | 1.3 | 1250 | 33 | 1.0 | 62 | 550 |
| Ex. 10 | 2.0 | $N_2$ | 1.6 | 1180 | 30 | 1.4 | 75 | 525 |
| Ex. 11 | 2.6 | Ar | 1.8 | 1140 | 38 | 1.6 | 65 | 485 |
| Ex. 12 | 2.3 | $N_2$ | 2.6 | 1170 | 46 | 1.25 | 50 | 475 |
| Ex. 13 | 2.0 | $CO_2$ | 2.4 | 1160 | 50 | 1.0 | 70 | 480 |
| Ex. 14 | 1.6 | Ar | 2.5 | 1160 | 31 | 1.1 | 55 | 560 |

TABLE 3

| Properties of the steel products in the Examples | | | | | | |
|---|---|---|---|---|---|---|
| | Cast strip thickness mm | Final product thickness mm | Yield strength MPa | Tensile strength MPa | Elon-gation % | Hole expansion rate % |
| Ex. 1 | 2.7 | 1.75 | 467 | 596 | 22 | 118 |
| Ex. 2 | 2.6 | 1.65 | 468 | 615 | 25 | 117 |
| Ex. 3 | 2.3 | 1.2 | 452 | 635 | 22 | 102 |
| Ex. 4 | 1.8 | 1.25 | 469 | 658 | 26 | 111 |
| Ex. 5 | 1.7 | 1.0 | 485 | 644 | 19 | 108 |
| Ex. 6 | 3.0 | 1.8 | 468 | 637 | 23 | 116 |
| Ex. 7 | 1.9 | 1.45 | 440 | 598 | 24 | 125 |
| Ex. 8 | 1.6 | 1.25 | 496 | 632 | 21 | 122 |
| Ex. 9 | 1.5 | 1.0 | 468 | 626 | 27 | 115 |
| Ex. 10 | 2.0 | 1.4 | 474 | 617 | 21 | 107 |
| Ex. 11 | 2.6 | 1.6 | 455 | 628 | 22 | 114 |
| Ex. 12 | 2.3 | 1.25 | 457 | 605 | 25 | 108 |

TABLE 3-continued

| Properties of the steel products in the Examples | | | | | | |
|---|---|---|---|---|---|---|
| | Cast strip thickness mm | Final product thickness mm | Yield strength MPa | Tensile strength MPa | Elon-gation % | Hole expansion rate % |
| Ex. 13 | 2.0 | 1.0 | 475 | 624 | 26 | 106 |
| Ex. 14 | 1.6 | 1.1 | 468 | 638 | 26 | 114 |

The chemical compositions of the Examples according to the present disclosure based on steel scrap are shown in Table 4, and the balance is Fe and other unavoidable impurities. The process parameters of the manufacturing method according to the present disclosure are shown in Table 5, and the properties of the product obtained finally are shown in Table 6.

To sum up, the high hole expansion steel manufactured with the designed steel composition using the thin strip continuous casting process according to the present disclosure has a yield strength of ≥440 MPa, a tensile strength of ≥590 MPa, an elongation of ≥19%, and a hole expansion rate of ≥100%.

TABLE 4

Chemical compositions of the steel Examples (wt. %)

| | c | Si | Mn | P | S | N | O | Als | Nb | Cu | Sn | Ca |
|---|---|---|---|---|---|---|---|---|---|---|---|---|
| Ex. 15 | 0.03 | 0.26 | 1.37 | 0.008 | 0.004 | 0.0054 | 0.0093 | 0.0009 | 0.03 | 0.35 | 0.022 | 0.005 |
| Ex. 16 | 0.01 | 0.20 | 0.92 | 0.013 | 0.003 | 0.0071 | 0.0110 | 0.0006 | 0.04 | 0.16 | 0.005 | 0.004 |
| Ex. 17 | 0.04 | 0.35 | 1.28 | 0.015 | 0.004 | 0.0068 | 0.0150 | 0.0004 | 0.06 | 0.10 | | 0.003 |
| Ex. 18 | 0.05 | 0.28 | 1.26 | 0.013 | 0.005 | 0.0067 | 0.0130 | 0.0008 | 0.04 | 0.56 | 0.040 | 0.003 |
| Ex. 19 | 0.04 | 0.45 | 0.85 | 0.009 | 0.002 | 0.0052 | 0.0120 | 0.0007 | 0.01 | 0.44 | 0.014 | 0.005 |
| Ex. 20 | 0.05 | 0.41 | 0.80 | 0.012 | 0.002 | 0.0046 | 0.0070 | 0.0008 | 0.03 | | 0.023 | 0.001 |
| Ex. 21 | 0.03 | 0.29 | 0.95 | 0.015 | 0.003 | 0.0040 | 0.0100 | 0.0005 | 0.07 | 0.38 | 0.035 | 0.002 |
| Ex. 22 | 0.02 | 0.38 | 1.30 | 0.014 | 0.005 | 0.0080 | 0.0085 | 0.0006 | 0.05 | 0.60 | 0.015 | 0.005 |
| Ex. 23 | 0.04 | 0.33 | 0.85 | 0.018 | 0.003 | 0.0078 | 0.0200 | 0.0003 | 0.03 | 0.37 | | 0.002 |
| Ex. 24 | 0.05 | 0.43 | 0.90 | 0.020 | 0.001 | 0.0065 | 0.0125 | 0.0004 | 0.06 | 0.53 | 0.016 | 0.004 |
| Ex. 25 | 0.02 | 0.60 | 0.85 | 0.010 | 0.002 | 0.0080 | 0.0090 | 0.0009 | 0.03 | | 0.038 | 0.005 |
| Ex. 26 | 0.05 | 0.57 | 1.50 | 0.012 | 0.005 | 0.0055 | 0.0118 | 0.0003 | 0.08 | 0.35 | 0.013 | 0.001 |
| Ex. 27 | 0.03 | 0.46 | 1.38 | 0.018 | 0.004 | 0.0045 | 0.0132 | 0.0006 | 0.07 | | 0.036 | 0.004 |
| Ex. 28 | 0.02 | 0.27 | 1.40 | 0.017 | 0.003 | 0.0074 | 0.0075 | 0.0005 | 0.04 | 0.27 | 0.027 | 0.003 |

TABLE 5

Process parameters of the steel products in the Examples

| | Cast strip thickness mm | Atmosphere in lower closed chamber | Oxygen concentration in lower closed chamber % | Hot rolling temperature ° C. | Hot rolling reduction rate/% | Hot-rolled strip thickness mm | Post-rolling cooling rate ° C./s | Coiling temperature ° C. |
|---|---|---|---|---|---|---|---|---|
| Ex. 15 | 2.6 | Ar | 3.3 | 1130 | 33 | 1.75 | 53 | 495 |
| Ex. 16 | 2.5 | Ar | 4.2 | 1200 | 46 | 1.35 | 60 | 535 |
| Ex. 17 | 2.3 | $N_2$ | 2.3 | 1110 | 43 | 1.30 | 59 | 565 |
| Ex. 18 | 1.8 | $CO_2$ | 2.5 | 1150 | 31 | 1.25 | 70 | 560 |
| Ex. 19 | 1.5 | Ar | 3.5 | 1185 | 33 | 1.00 | 52 | 570 |
| Ex. 20 | 3.0 | Ar | 2.8 | 1100 | 40 | 1.80 | 52 | 550 |
| Ex. 21 | 1.9 | $N_2$ | 1.5 | 1190 | 21 | 1.50 | 55 | 505 |
| Ex. 22 | 1.8 | $CO_2$ | 0.6 | 1120 | 31 | 1.25 | 60 | 480 |
| Ex. 23 | 1.6 | $N_2$ | 1.3 | 1250 | 38 | 1.00 | 62 | 550 |
| Ex. 24 | 2.0 | $N_2$ | 1.6 | 1180 | 30 | 1.40 | 75 | 525 |
| Ex. 25 | 2.6 | Ar | 1.8 | 1140 | 38 | 1.60 | 65 | 485 |
| Ex. 26 | 2.2 | $N_2$ | 2.6 | 1170 | 43 | 1.25 | 50 | 475 |
| Ex. 27 | 2.0 | $CO_2$ | 2.4 | 1160 | 50 | 1.00 | 70 | 480 |
| Ex. 28 | 1.7 | Ar | 2.5 | 1160 | 35 | 1.10 | 55 | 560 |

TABLE 6

Properties of the steel products in the Examples

| | Cast strip thickness mm | Final product thickness mm | Yield strength MPa | Tensile strength MPa | Elon-gation % | Hole expansion rate % |
|---|---|---|---|---|---|---|
| Ex. 15 | 2.6 | 1.75 | 458 | 598 | 21 | 115 |
| Ex. 16 | 2.5 | 1.35 | 488 | 612 | 25 | 111 |
| Ex. 17 | 2.3 | 1.3 | 460 | 625 | 19 | 112 |
| Ex. 18 | 1.8 | 1.25 | 463 | 638 | 28 | 103 |
| Ex. 19 | 1.5 | 1.0 | 485 | 645 | 23 | 108 |
| Ex. 20 | 3.0 | 1.8 | 467 | 638 | 28 | 112 |
| Ex. 21 | 1.9 | 1.5 | 440 | 599 | 22 | 117 |
| Ex. 22 | 1.8 | 1.25 | 498 | 636 | 21 | 120 |
| Ex. 23 | 1.6 | 1.0 | 463 | 613 | 24 | 113 |
| Ex. 24 | 2.0 | 1.4 | 474 | 614 | 20 | 117 |
| Ex. 25 | 2.6 | 1.6 | 452 | 625 | 22 | 103 |
| Ex. 26 | 2.2 | 1.25 | 469 | 618 | 23 | 105 |
| Ex. 27 | 2.0 | 1.0 | 473 | 615 | 27 | 107 |
| Ex. 28 | 1.7 | 1.1 | 465 | 642 | 26 | 118 |

What is claimed is:

1. A Nb microalloyed high strength high hole expansion steel comprising the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050%, Nb: 0.01-0.08%, optionally one or both of Cu: 0.1-0.6% and Sn: 0.005-0.04%, wherein, Mn/S>250, total oxygen $[O]_T$: 0.007-0.020%, and a balance of Fe and unavoidable impurities, wherein a microstructure of the high hole expansion steel consists of ferrite and bainite, wherein the bainite phase has a ratio of ≥15%; and wherein the high hole expansion steel has a yield strength of ≥440 MPa, a tensile strength of ≥590 MPa, an elongation of ≥19%, and a hole expansion rate of ≥100%.

2. The Nb microalloyed high strength high hole expansion steel according to claim 1, wherein the Nb microalloyed high strength high hole expansion steel comprises the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050%, Nb: 0.01-0.08%, Mn/S>250, total oxygen $[O]_T$: 0.007-0.020%, and a balance of Fe and unavoidable impurities, and satisfies: it comprises one or both of Cu: 0.1-0.6% and Sn: 0.005-0.04%.

3. The Nb microalloyed high strength high hole expansion steel according to claim 1, wherein the Nb microalloyed high strength high hole expansion steel has a thickness of 0.8-2.5 mm.

4. A manufacturing method for the Nb microalloyed high strength high hole expansion steel according to claim 1, comprising the following steps:

1) smelting wherein smelting is performed on the chemical composition of claim 1; wherein during smelting, a basicity a=$CaO/SiO_2$ , in mass ratio, for slagging is controlled at a<1.5,;

wherein a low-melting-point $MnO-SiO_2-Al_2O_3$ ternary inclusion is required and a $MnO/SiO_2$ ratio of $MnO-SiO_2-Al_2O_3$ ternary inclusion is controlled at 0.5-2; wherein a free oxygen content $[O]_{Free}$ in the molten steel is 0.0005-0.005%; and wherein in the molten steel, Mn/S>250;

2) continuous casting wherein twin-roll thin strip continuous casting is used for continuous casting, wherein a 1.5-3 mm thick cast strip is formed at the smallest gap between two crystallization rolls;

wherein the crystallization rolls have a diameter of 500-1500 mm; wherein water is supplied to the inside of the crystallization rolls for cooling; wherein a casting machine has a casting speed of 60-150 m/min; wherein a two-stage system for dispensing and distributing molten steel is used for molten steel delivery in the continuous casting;

3) lower closed chamber protection wherein after a cast strip exits the crystallization rolls, the cast strip has a temperature of 1420-1480° C., and it enters a lower closed chamber directly, wherein a non-oxidizing gas is supplied to the lower closed chamber, wherein an oxygen concentration, in volume, in the lower closed chamber is controlled at <5%; and wherein the cast strip has a temperature of 1150-1300° C. at an outlet of the lower closed chamber;

4) on-line hot rolling wherein the cast strip is delivered through pinch rolls in the lower closed chamber to a rolling mill, and rolled into a rolled strip steel at a rolling temperature of 1100-1250° C. and a hot rolling reduction rate controlled at 10-50%, wherein the rolled steel strip has a thickness of 0.8-2.5 mm;

5) post-rolling cooling wherein the rolled strip steel is cooled after on-line hot rolling, wherein the strip steel is cooled by gas atomization cooling, wherein a cooling rate of the gas atomization cooling is ≥50° C./s; and 6) coiling of the strip steel wherein the hot-rolled strip steel is directly coiled into a coil after the cooling, wherein a coiling temperature is 470-570° C.

5. The manufacturing method according to claim 4, wherein, in step 1), electric furnace steelmaking or converter steelmaking is employed for the smelting to obtain molten steel, and then the molten steel enters an LF furnace, a VD/VOD furnace, or an RH furnace for refining.

6. The manufacturing method according to claim 4, wherein, in step 1), an electric furnace is used for smelting to produce molten steel, wherein 100% steel scrap is selected as the raw material for smelting without pre-screening; or a converter is used for smelting to produce molten steel, wherein steel scrap is added to the converter in an amount of ≥20% of the raw material for smelting without pre-screening; then the molten steel is delivered to an LF furnace, VD/VOD furnace or RH furnace for refining.

7. The manufacturing method according to claim 4, wherein, in step 3), the non-oxidizing gas is $N_2$, Ar, or $CO_2$ gas produced by sublimation of dry ice.

8. The manufacturing method according to claim 4, wherein, in step 5), the gas atomization cooling utilizes a gas-water ratio of 15:1-10:1, a gas pressure of 0.5-0.8 MPa, and a water pressure of 1.0-1.5 MPa.

9. The manufacturing method according to claim 4, wherein, in step 6), the coiling utilizes double-coiler coiling or Carrousel coiling.

10. The manufacturing method according to claim 4, wherein, in step 5), the cooling rate is 50-75° C./s.

11. The manufacturing method according to claim 4, wherein, in step 6), the hot-rolled and cooled strip steel is directly coiled into a coil after a poor-quality head portion of the strip steel is cut off with a head shear.

12. The Nb microalloyed high strength high hole expansion steel according to claim 1, wherein the Nb microalloyed high strength high hole expansion steel has a thickness of 1.0-1.8 mm.

13. The manufacturing method according to claim 4, wherein the basicity a=$CaO/SiO_2$ , in mass ratio, for slagging is controlled at a<1.2, or a=0.7-1.0; and/or the $MnO/SiO_2$ ratio of $MnO-SiO_2-Al_2O_3$ ternary inclusion is controlled at 1-1.8; and/or the crystallization rolls have a diameter of 800 mm; and/or the hot rolling reduction rate controlled at 30-50%; and/or the rolled steel strip has a thickness of 1.0-1.8 mm.

14. The manufacturing method according to claim 4, wherein the Nb microalloyed high strength high hole expansion steel comprises the following chemical elements in weight percentages: C: 0.01-0.05%, Si: 0.2-0.6%, Mn: 0.8-1.5%, P≤0.02%, S≤0.005%, N≤0.008%, Als: <0.001%, Ca≤0.0050% , Nb: 0.01-0.08%, Mn/S>250, total oxygen $[O]_T$: 0.007-0.020%, and a balance of Fe and unavoidable impurities, and satisfies: it comprises one or both of Cu: 0.1-0.6% and Sn: 0.005-0.04%.

* * * * *